US011346156B2

(12) United States Patent
Boussi et al.

(10) Patent No.: US 11,346,156 B2
(45) Date of Patent: May 31, 2022

(54) ADJUSTABLE DOUBLE BEND STEERABLE DRILLING MOTOR

(71) Applicant: STORMELO INVESTMENT INC

(72) Inventors: Bachar Boussi, Dubai (AE); Mohamad Bussy, Dubai (AE)

(73) Assignee: STORMELO INVESTMENT INC, Panama (PA)

( * ) Notice: Subject to any disclaimer, the term of this patent is extended or adjusted under 35 U.S.C. 154(b) by 0 days.

(21) Appl. No.: 16/488,677

(22) PCT Filed: Dec. 14, 2017

(86) PCT No.: PCT/IB2017/057916
§ 371 (c)(1),
(2) Date: Aug. 26, 2019

(87) PCT Pub. No.: WO2018/158627
PCT Pub. Date: Sep. 7, 2018

(65) Prior Publication Data

US 2020/0040659 A1 Feb. 6, 2020

Related U.S. Application Data

(60) Provisional application No. 62/465,860, filed on Mar. 2, 2017.

(51) Int. Cl.
*E21B 7/06* (2006.01)
*E21B 4/02* (2006.01)

(52) U.S. Cl.
CPC ..... *E21B 7/068* (2013.01); *E21B 4/02* (2013.01); *E21B 7/067* (2013.01)

(58) Field of Classification Search
CPC ... E21B 7/04; E21B 7/068; E21B 4/02; E21B 7/067
See application file for complete search history.

(56) References Cited

U.S. PATENT DOCUMENTS 4,067,404 A * 1/1978 Crase ..... E21B 7/067 175/75
4,303,135 A * 12/1981 Benoit ..... E21B 7/067 175/73
4,745,982 A * 5/1988 Wenzel ..... E21B 7/067 166/237
2002/0153723 A1* 10/2002 Robin ..... E21B 7/067 285/184

* cited by examiner

*Primary Examiner* — Giovanna Wright
*Assistant Examiner* — Dany E Akakpo
(74) *Attorney, Agent, or Firm* — Im IP Law; Chai Im; C. Andrew Im

(57) ABSTRACT

An adjustable drilling motor includes a center housing having a connection at each longitudinal end for coupling to a respective bent sub. The connections each subtend a same angle from a centerline of the center housing. The angles are in a same. A bent housing is connected to each end of the center housing. Each housing has a connection at one end for coupling to the center housing. Each bent housing subtends a selected angle. The motor includes makeup rings having a selected thickness disposed between each bent housing and the center housing whereby selected angle magnitude markings on each bent housing correspond to adjacent markings on the center housing when each bent housing is assembled to the center housing to a predetermined torque.

14 Claims, 8 Drawing Sheets

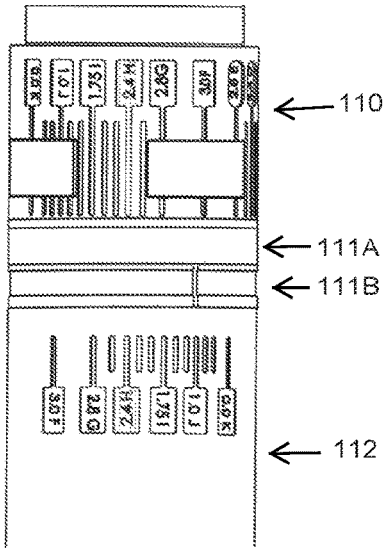
FIG. 13
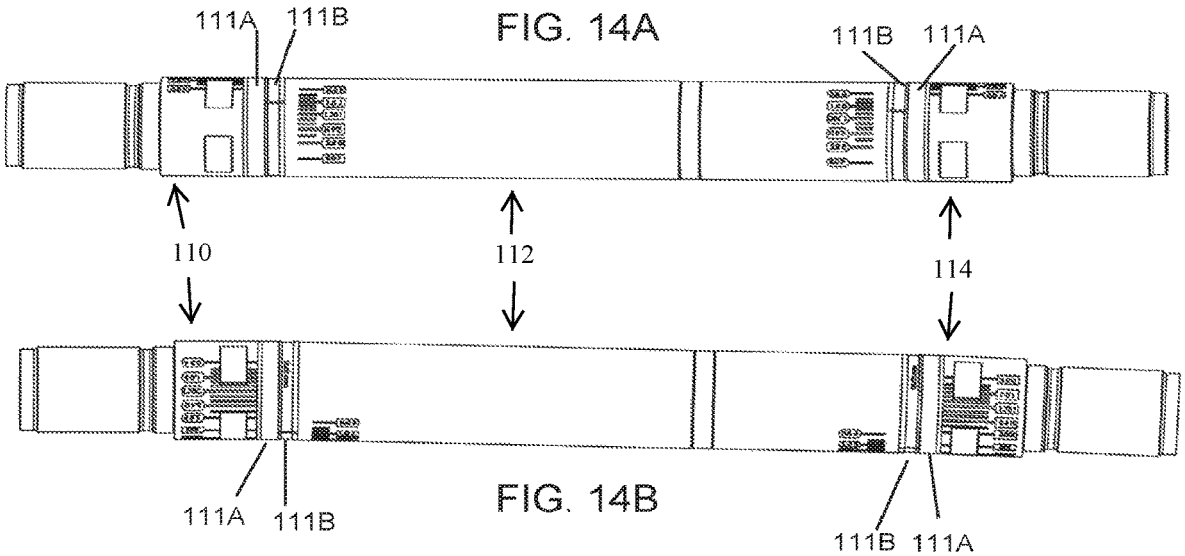
FIG. 14A
FIG. 14B

ADJUSTABLE DOUBLE BEND STEERABLE DRILLING MOTOR

BACKGROUND

This disclosure relates to the field of steerable drilling motors. More particularly, the disclosure relates to steerable drilling motors having an adjustable bend angle in the motor housing.

Drilling subsurface wellbores with so-called "steerable" drilling motors is an important method for controlling wellbore trajectory. Drilling motors, including steerable drilling motors, comprise a power section, in which rotational energy to turn an output shaft of the motor disposed in a housing that is coupled within a drill string in the wellbore. The output shaft may be coupled to a drill bit. The housing may comprise a bend therein, in some examples in a range of ½ degree to 4 degrees angle subtended between an upper end of the housing and a lower end of the housing where the output shaft is disposed. The power section may comprise an hydraulic power conversion mechanism, for example, a positive displacement motor or a turbine motor that converts flow of drilling fluid through the drill string into rotational energy at the output shaft. Other types of power sections are known in the art, and hydraulic power conversion should not be construed as a limitation on the scope of the present disclosure. The foregoing type of steerable drilling motor having only one bend angle may be referred to as a "single bend" steerable drilling motor.

Steerable drilling motors may maintain an existing trajectory (geodetic orientation) of a wellbore by being rotated along with the drill string used to move a string of drill pipe and drilling tools along the wellbore to lengthen the wellbore, i.e., to drill the wellbore. Trajectory may be changed by stopping rotation of the drill string and orienting the above-described bend in the housing such that a plane of the bend (called "toolface") is oriented along the direction which is intended to change the trajectory as drilling proceeds by the output shaft rotating a drill bit.

A parameter related to the capacity of a steerable drilling motor to change the trajectory during drilling of a wellbore is the deflection rate of the steerable drilling motor. The deflection rate of a steerable drilling motor is mainly related to the distance between the bend in the steerable drilling motor housing and the drill bit. Deflection rate increases as the bend angle moves toward a bottom stabilizer and it decreases as the bend angle moves towards the top stabilizer; when the bend angle arrives at the bottom stabilizer, a conventional steerable motor, that is one having a single-bend housing, obtains a maximum deflection rate.

With a high speed drilling motor such as a turbine motor, the position of the bend is related to the position of an internal flexible shaft, so that the minimum distance between the bend and the drill bit is limited by the position of the flexible shaft.

Another limitation of a single bend steerable drilling motor is side load between the wall of the wellbore and the motor housing at the bend position. The side load generates stress on the fulcrum point of the resting position of single bend drilling motors. As illustrated in FIG. 1A the fulcrum 8A of the motor 8 (the point of the bend) makes contact with the wall 12A of the wellbore 12 as the drill bit 18 advances. A single bend encounters stress that reduces the motor's steering effectiveness on one hand, and friction between the wellbore and the bottom hole assembly (an assembly of drilling tools that includes the drilling motor) on the other hand is characterized by parasitic torque, excessive wear on the exterior of drilling tools and consequent increased risk of failures. The single bend motor 8 has three points of contact 8A, 8B, 8C between the motor 8 and the wall 12A of the wellbore 12. The single bend motor 8 thus may have limited capability to change trajectory direction.

SUMMARY

An adjustable double bend steerable drilling motor according to one aspect of the disclosure includes a center housing having a connection at each longitudinal end for coupling to a respective bent sub. The connections each subtend a same angle from a centerline of the center housing. The angle at each longitudinal end is in a same direction as the angle at the other longitudinal end. A bent housing is connected to each end of the housing. Each housing has a connection at one end for coupling to the center housing. Each housing subtends a selected angle between a coupling for the bent housing within a drill string and the center section. The motor includes makeup rings having a selected thickness disposed between each bent housing and the center housing whereby selected angle magnitude markings on each bent housing correspond to adjacent markings on the center housing when each bent housing is assembled to the center housing to a predetermined torque.

In some embodiments, a bend angle in an upper bent housing is substantially identical to a bend angle in a lower bent sub.

In some embodiments an upper bent housing and a lower bent housing are affixable to the center housing such that a total bend angle in the motor is within a range from zero to a sum of the bend angles of the upper and lower bent subs.

In some embodiments the makeup rings comprise a split ring and an adjustable thickness ring, the adjustable thickness ring adjustable to a selected thickness. In some embodiments the adjustable thickness ring has a thickness selected by machining. In some embodiments the adjustable thickness ring comprises opposed rings each having a tapered shoulder on one side such that selective rotation of the opposed rings results in the selected thickness.

In some embodiments the oriented axis of the upper bent housing, the center housing and the lower bent housing are all on a single plane at any total bend angle and provide a single toolface orientation.

In some embodiments an upper bend angle and a lower bend angle are set through oriented shoulders lockable in rotation with teeth to allow on site adjustment without dismantling the bent housings from the center housing.

In some embodiments the makeup rings comprise opposed pairs of sloped rings lockable in rotation assembled in a selected rotational orientation to a selected bend angle without dismantling the upper bent housing from the center housing and the center housing from the lower bent housing.

A method for drilling a well according to another aspect of the present disclosure includes assembling an upper bent housing, a center housing and a lower bent housing of a double bend steerable drilling motor housing so as to cause the double bend steerable drilling motor to have a selected total bend angle. Fluid is moved through a power section in the double bend steerable drilling motor to rotate a drill bit rotationally coupled to a longitudinal end of the double bend steerable drilling motor. The drill bit is advanced through the well by applying axial force to the double bend steerable drilling motor.

Some embodiments include rotating the double bend steerable drilling motor to maintain a wellbore trajectory during the advancing the drill bit.

In some embodiments the center housing comprises a connection at each longitudinal end for coupling to a respective one of the upper bent housing and the lower bent housing.

In some embodiments, the connection at each longitudinal end subtends a same angle from a centerline of the center housing.

In some embodiments, the angle at each longitudinal end is oriented in a same direction as the angle at the other longitudinal end.

In some embodiments, the bent housing connected to each longitudinal end of the center housing each comprises a connection at one end for coupling to a respective connection on the center housing.

In some embodiments, each bent housing subtends a selected angle between the respective connection and a connector for coupling the bent housing within a drill string. In some embodiments, the double bend steerable drilling motor comprises makeup rings having a selected thickness disposed between each bent housing and the center housing whereby selected angle magnitude markings on each bent housing correspond to adjacent markings on the center housing when each bent housing is assembled to the center housing to a make up torque.

BRIEF DESCRIPTION OF THE DRAWINGS

FIG. 13 shows using fixed thickness rings and a machinable thickness ring between the bent housing and the center housing so that selected angle indication marks can be aligned when the housing is made up to the center housing to the required torque.

FIGS. 14A and 14B show, respectively, an ADB motor having bent housings to result in a 2.4 degree bend angle, first, in FIG. 14A in the plane of the bend and second, in FIG. 14B in the plane perpendicular to the bend plane.

DETAILED DESCRIPTION

Figure 1A:
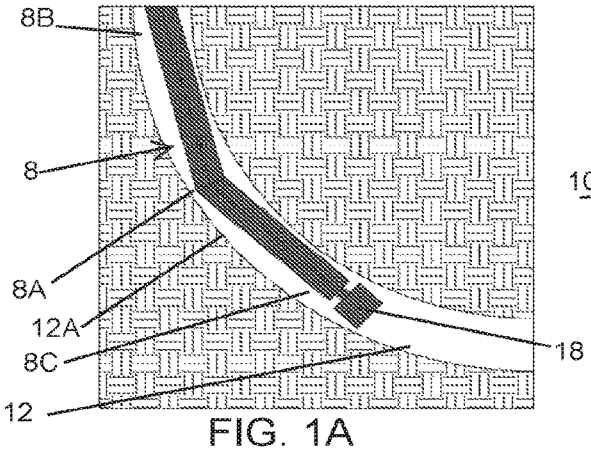
FIG. 1A (PRIOR ART)
FIG. 1A shows a schematic illustration of directional drilling using a single bend steerable drilling motor.
Figure 1B:
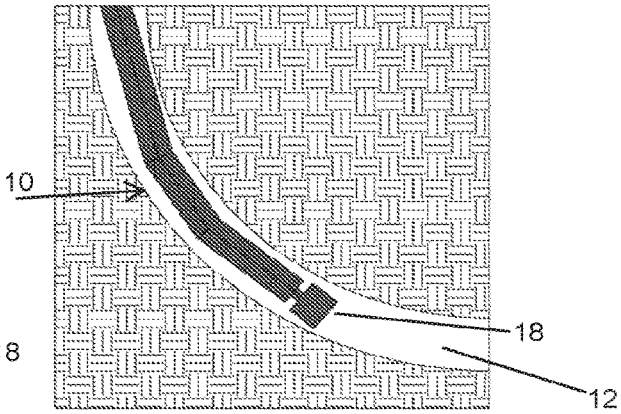
FIG. 1B shows a schematic illustration of directional drilling using a double bend steerable drilling motor.

FIG. 1B shows a schematic diagram of drilling a wellbore 12 with a double bend adjustable steerable drilling motor (hereinafter referred to as "ADB motor") 10 so as to be able to change the trajectory of the wellbore 12 as a drill bit 18 rotates and thus advances (i.e., drills the wellbore). The fulcrum point in the ADB motor 10 is intended to be as close as practical to a flat surface, thereby decreasing the stresses on the ADB motor 10 and the risks of motor "hanging." Decreased motor hanging may provide a higher turn rate (i.e., change in wellbore trajectory with respect to distance along the longitudinal axis of the wellbore) for the ADB motor 10 as contrasted with a single bend motor (e.g., as illustrated in FIG. 1A). A possible advantage of the ADB motor 10 is reduced stress from less contact with the wellbore. As explained in the Background section herein, a single bend motor (8 in FIG. 1A) has three points of contact (8A, 8B, 8C in FIG. 1A) between the motor (8 in FIG. 1A) and the wall 12A of the wellbore 12, as contracted with no contact using the ADB motor 10. The single bend motor (FIG. 1A) thus may have limited capability to change trajectory direction. It is expected therefore that an ADB motor 10 will change trajectory more rapidly than a single bend motor having the same total bend angle.

During wellbore drilling, if it is intended to maintain the trajectory of the wellbore 12, the ADB motor may be rotated by a drill string (see 15 in FIG. 2A) and a power section (see 17 in FIG. 2A) may convert flow of drilling fluid through the drill string into rotational energy to turn the drill bit 18. Axial force may be applied to the drill bit 18 by applying some of the weight of the drill string (15 in FIG. 2A) to the ADB motor 10. If it is intended to change the trajectory of the wellbore 12, drill string rotation may be stopped, the ADB motor 10 may be rotationally oriented such that the toolface in in a desired direction of trajectory change and drill may resume using only the energy generate by the power section (17 in FIG. 2A) to rotate the drill bit 18.

An ADB motor housing according to the present disclosure may comprise three principal components: an upper bent sub, a center housing (which may comprise the power section 17 in FIG. 2A) and a lower bent sub. The upper and lower bent subs in some embodiments may be identical to each other. The identity may include threaded connections to couple the ADB motor 10 to the drill string and associated drilling tools, and/or the threaded connections may be female at one end, that is a "box connection" and male at the other end, that is a "pin connection." When the upper and lower bent subs are connected to the center housing they may form a plane of mirror symmetry. The total bend angle of the ADB motor 10 is the sum of a bend angle subtended between the upper bent housing and the center housing and the center housing and the lower bent sub. The range of possible bend angles is therefore between zero and the sum of the bend angles of the upper bent housing and the lower bent sub.

The angle subtended between the ADB motor principal components may be selected by designing the thread connection axis at a desired angle relative to the ADB motor main axis (in FIGS. 3 to 7, reference numerals 1, 3 and 6 are used to show main axes, the remaining axes are thread axes). The plane in which the thread axis is maximum will be referred to as the reference plane (FIGS. 3, 4, 5 all represent the angle of thread connection in the reference plane i.e., maximum thread connection angle).

While connecting the ADB motor principal components to each other, the required total motor bend angle (that is the total bend angle subtended between the longitudinal ends of the assembled principal components) may be set by one of the following procedures. Zero total motor bend angle may be set by orienting the upper and lower bent subs oppositely symmetrical. A maximum total motor bend angle may be set by orienting the upper and lower bent subs in opposed symmetry with respect to a plane intersecting the maximum bend angle of both the upper bent housing to center housing connection and the center housing to lower bent housing connection. Intermediate total motor bend angles may be set when both the upper bent housing to center housing connection and the center housing connection to the lower bent housing are in opposed symmetry with respect to the plane intersecting the angle markings at both of the foregoing connections.

The ADB motor may designed in a way that any desired intermediate total bend angle is set in a common plane where the axes of the upper bent housing, center housing and lower bent housing outer diameters meet. Identifying angle marks may be arranged on the outer surface of the center housing and the upper and lower bent housing outer surfaces to set any intermediate angle in this same common plane. This principle allows proper identification of ADB motor toolface (i.e., the orientation of the plane of maximum bend angle) for any angle setting required.

Eq. (1) below provides all circumferential angle markings, a position for each bend angle setting. The marking positions also define the toolface orientation. The formula can also be used to better understand the maximum and zero angle settings.

$$\theta_T = 90° - \left[\cos^{-1}\left(\frac{\sin\theta_A}{\sin\theta_{A_{max}}}\right)\right] \tag{1}$$

wherein the parameters therein represent:

$\theta_T$=Angular position of mark for a True ADB Motor angle relative to 0° Mark in cross section;

$\theta_A$=Required ADB Motor Angle (Selected Motor Bend); and $\theta_{A_{max}}$=Maximum ADB Motor Angle (Max Motor Bend).

Apart from the above angle setting explanation, the design of the ADB motor may also ensure that angle selection indication marking between each of the upper bent housing and the center housing and the lower bent housing and the center housing are aligned while operating the ADB motor in order to maintain the assembly integrity. Such alignment may be obtained by providing a threaded connection between each of the upper bent housing and the center housing and the lower bent housing and the center housing with a specified make up torque to prevent misalignment or unthreading during drilling. To make the two bend angles adjustable at the wellbore drilling location, in some embodiments a pair of rings and spacers may be used between the ADB motor component connections described. The rings may have different thicknesses to set the tool bend angle while each connection is made up to the required torque. Below are the main reasons for usage of these rings:

The thickness of the rings may be a minimum distance '$x_o$' between the ADB components' shoulders plus a varying length 'd' required to provide the selected bend angle. The formula below may be used to calculate the total length or thickness of the rings needed for setting each bend with proper torque and alignment of marks. The relation can also be used to better understand the ring length required for the Maximum and Zero bend angle settings by inputting the values of angles at the foregoing bend angle settings.

$$d = x_o \pm 2\left(\frac{\theta_T}{360°}p\right); \text{ or} \tag{2}$$

$$d = x_o \pm 2\left[\frac{90° - \left[\cos^{-1}\left(\frac{\sin\theta_A}{\sin\theta_{A_{max}}}\right)\right]}{360°}p\right] \tag{3}$$

wherein $\theta_T$=Angular position of mark for a True ADB motor angle relative to 0° Mark in cross section;

$x_o$=Minimum Distance between Male & Female ADB Shoulder at 0.0° Bend Angle; and p=Pitch of Thread.

Figure 2A:
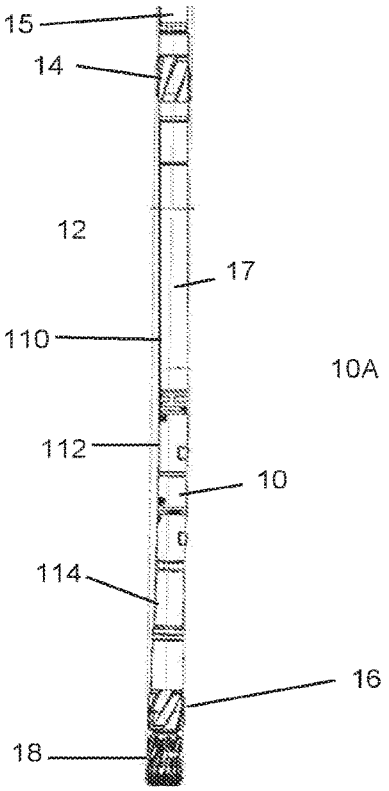
FIGS. 2A and 2B show, respectively, relative interference in a well drilled using a double bend motor (FIG. 2A) and a single bend motor (FIG. 2B).
Figure 2B:
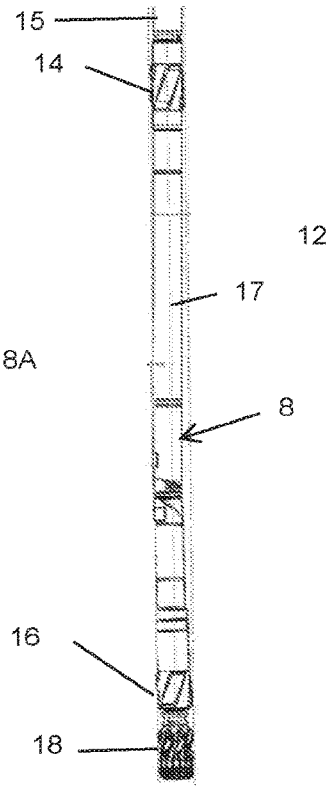
FIG. 2B (PRIOR ART)

FIGS. 2A and 2B illustrate reduction in interference that may be obtained using an ADB motor according to the present disclosure. FIG. 2A shows an ADB motor 10 comprising a center housing 112 coupled between an upper bent housing 110 and a lower bent housing 114. Stabilizers 14, 16 may be suitably located in the drill string 15 as would ordinarily be used with steerable drilling motors. FIG. 2B shows drilling a similar wellbore wherein a single bend motor 8 is used. Interference between the wellbore wall and the motor housing (10A in FIG. 2A and 8A in FIG. 2B) may be substantially reduced using an ADB motor 10. The drilling tool assemblies shown in FIGS. 2A and 2B are only meant to serve as examples and are not intended to limit the scope of drilling tool assemblies which may make use of an ADB motor according to the present disclosure. The respective motors (10 in FIG. 2A and 8 in FIG. 2B) may comprise a power section 17 which converts flow of drilling fluid into rotational energy to turn a drill bit 18 coupled to a bottom end of the respective motors (10 in FIG. 2A and 8 in FIG. 2B). The power section 17 may be, for example and without limitation a single or multiple lobe positive displacement motor or a turbine motor. As previously explained, when it is desired to change the trajectory of a wellbore, rotation of the drill string 15 may be stopped, the motor 10 may be oriented such that its toolface is in a selected rotational orientation and drill may resume by rotating the drill bit 18 using rotational energy generated by the power section 17. If it is desired to maintain trajectory, the drill string 15 may be rotated during drilling.

An amount of interference between the wall of the wellbore for the ADB motor is shown at 10A in FIG. 2A and at 8A in FIG. 2B. Interference may be reduced using the ADB motor.

Figure 3:
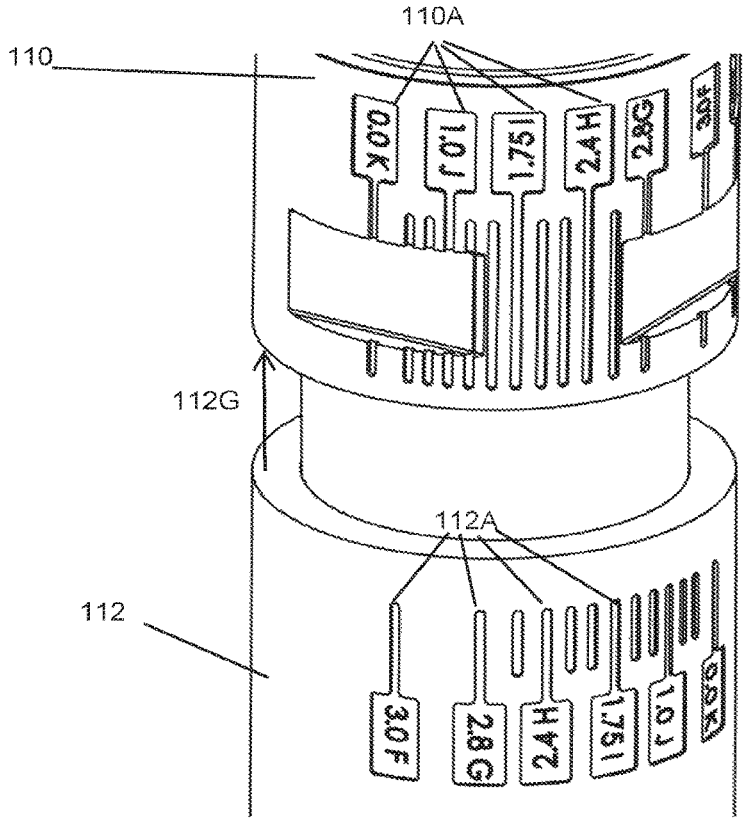
FIG. 3 shows an example embodiment of bend angle alignment marks between a bent housing and a center housing of an adjustable double bend (ADB) motor according to the present disclosure.

FIG. 3 shows an example of markings 110A made on the outer surface of the upper bent housing 110 to indicate a subtended angle between a rotary orientation of the upper bent housing 110 with reference to a plane of maximum bend. The connection between the upper bent housing 110 and the center housing 112 may be conventional drilling tool threads, as will be explained with reference to FIGS. 4 and 5. Corresponding markings 112A may be made on the exterior surface of the center housing 112. A gap 112G between the upper bent housing 110 and the center housing 112 may be filled with rings (explained below with reference to FIGS. 12 and 13) such that when the upper bent housing 110 is connected to the center housing 112 at the correct "make up" torque, corresponding markings on the upper bent housing 110 and the center housing 112 will be aligned, thus providing a selected bend angle at the foregoing connection.

Figure 4:
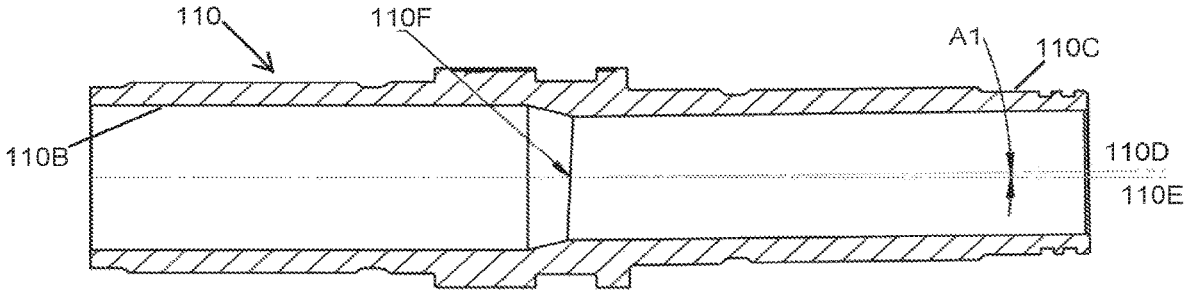
FIG. 4 shows an example embodiment of a bent housing for an ADB motor.

FIG. 4 shows a cross section of the upper bent housing 110. The upper bent housing 110 may comprise a first threaded connector 110B for coupling within a drill string (15 in FIG. 2A). Such first threaded connector 110B may be a pin (male) end or a box (female) end, depending on the specific drill string configuration. A center axis 110E of the drill string (15 in FIG. 2A) extends along the center line of the upper bent housing 110 until a longitudinal position of a deflection point 110F. From the deflection point 110F to an end of a second threaded connector 110C (to connect the upper bent housing 110 to the center housing (112 in FIG. 5), the center axis 110D of the upper bent housing 110 subtends a selected angle A1 with reference to the drill string center axis 110E.

Figure 5:
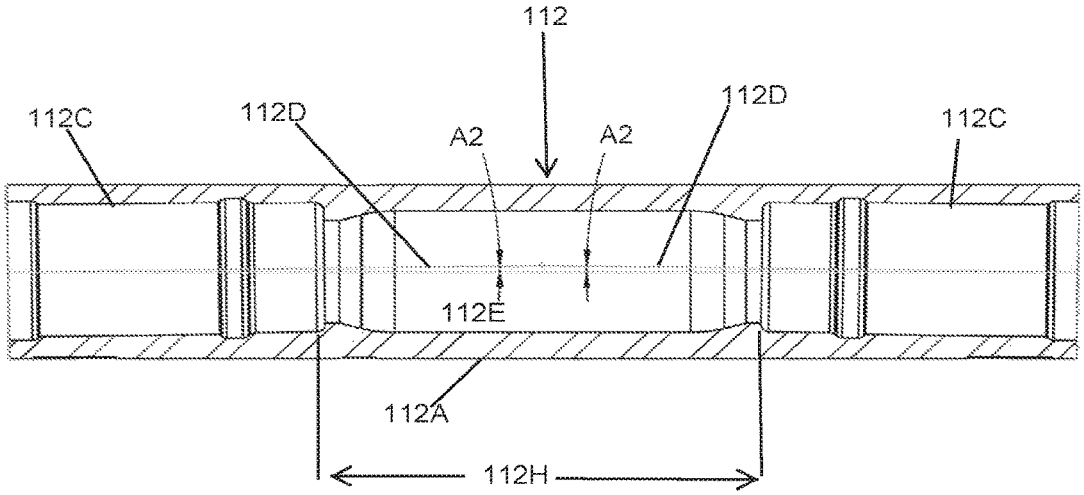
FIG. 5 shows an example embodiment of a center housing for an ADB motor.

An example embodiment of the center housing 112 is shown in FIG. 5. The center housing 112 may comprise a housing 112A having a threaded connector 112C on each longitudinal end. A center portion 112H of the housing 112A may be coaxial or axially parallel with the drill string (15 in FIG. 2A). End portions of the housing 112A, i.e., in each threaded connector 112C, may each have a centerline 112D that defines a selected bend angle A2 with reference to a line 112E parallel to or coaxial with the drill string (15 in FIG. 2A). Thus, when each bent housing (110 in FIGS. 4 and 114 in FIG. 6) is connected to the center housing 112, a selected angle is subtended between the center housing 112 and each bent housing (110, 114).

Figure 6:
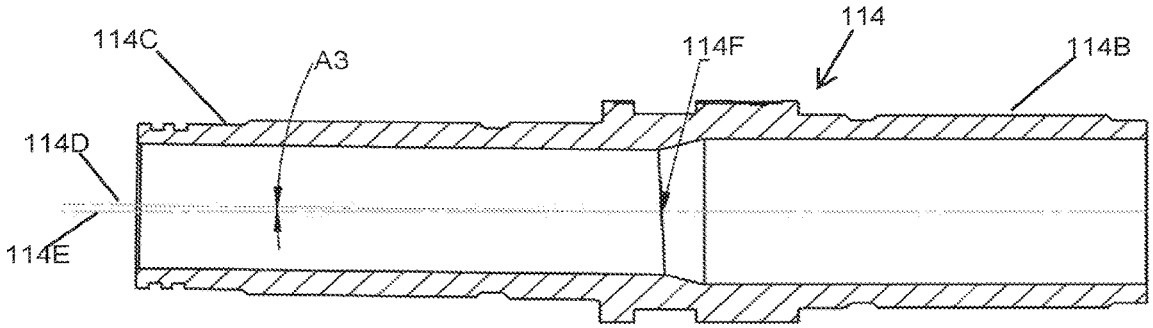
FIG. 6 shows an example embodiment of a lower or second bent housing for coupling to a center housing of an ADB motor.

FIG. 6 shows a cross section of an example embodiment of the lower bent housing 114. A first threaded coupling 114C may be provided for connecting the lower bent housing 114 to the center housing (112 in FIG. 5). A second threaded coupling 114B may be provided to connect the lower bent housing 114 to a drill string or a component therein, for example the drill bit (18 in FIG. 2A). The lower bent housing 114 subtends a selected angle A3 from the centerline 114E of the drill string (15 in FIG. 2A) beginning at an intersection point 114F and extending along a center line 114D of the first threaded coupling 114C. In some embodiments, the lower bent housing 114 may be arranged substantially identically to the upper bent housing (110 in FIG. 4).

Figure 7:
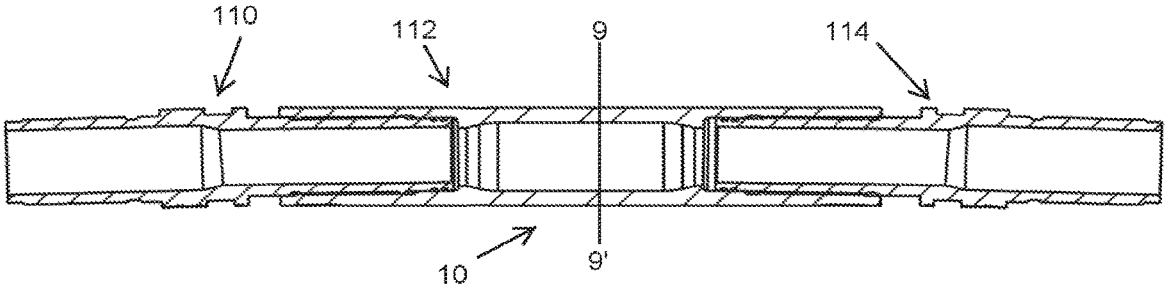
FIG. 7 shows an assembled ADB motor in cross section including an upper (or first) bent housing, a center housing and a lower (or second) bent housing. The bent housings are oriented to provide the ADB motor with zero total bend.

FIG. 7 shows the lower bent housing 114, center housing 112 and upper bent housing 110 assembled so that the bent subs 110, 114 subtend equal but opposed angles such that the total bend angle in the ADB motor 10 is zero. A cross-sectional view along line 9'9' of the ADB motor configured as illustrated in FIG. 7 is shown in FIG. 9.

Figure 8:
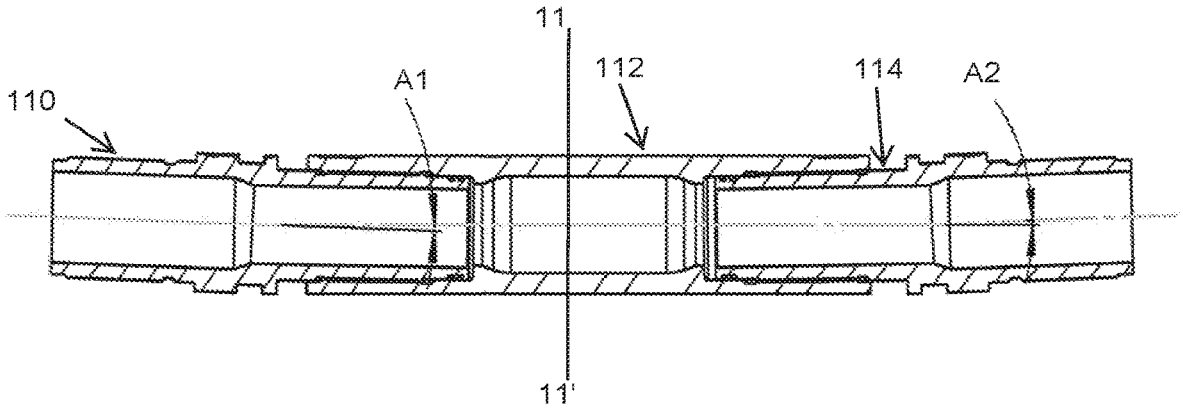
FIG. 8 shows the assembled ADB motor of FIG. 7 wherein the bent subs are oriented to provide a maximum total bend angle.

FIG. 8 shows the components of FIG. 7 but wherein the lower bent housing 114 and upper bent housing 110 are coupled to the center housing 112 so that a maximum bend angle is obtained. A cross-sectional view along line 11-11' in FIG. 8 is illustrated in FIG. 11.

Figure 9:
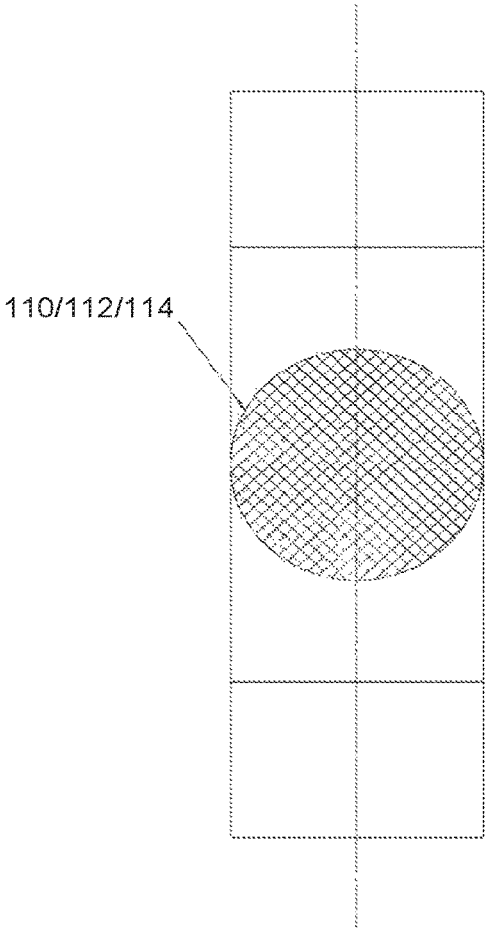
FIG. 9 shows a cross section of the motor of FIG. 7 wherein there is zero total bend angle.
Figure 10:
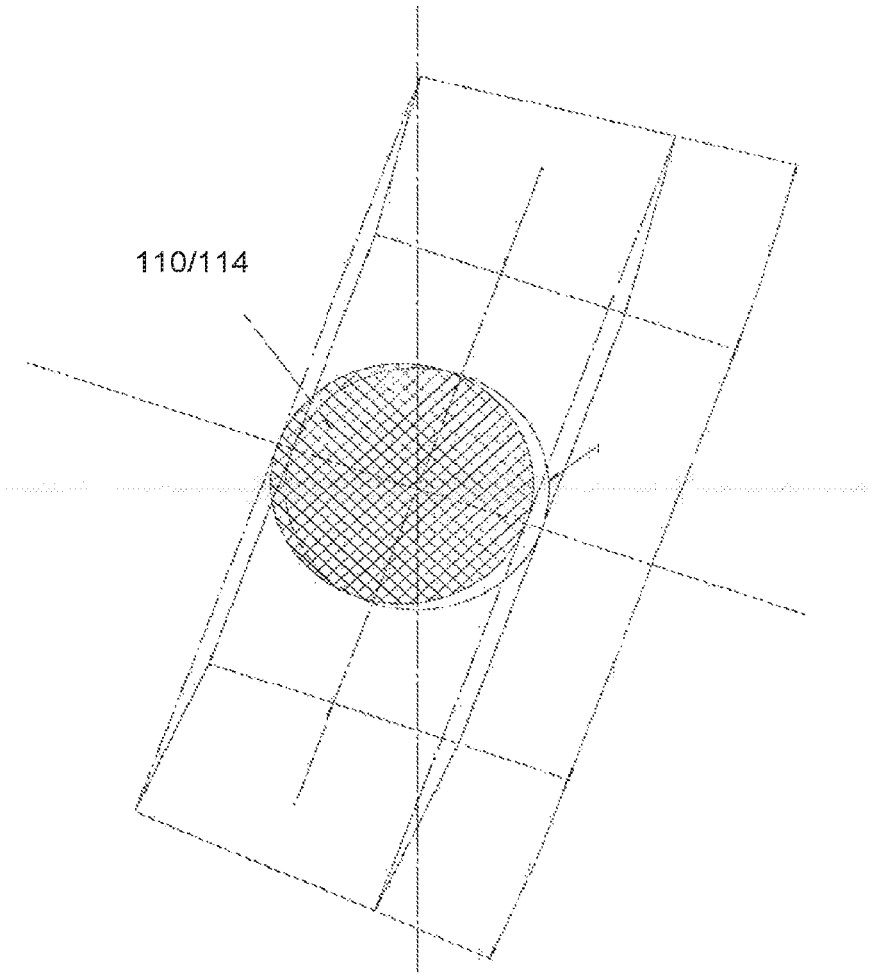
FIG. 10 shows a cross section of the ADB motor wherein there is a 1.0 degree total angle. The upper bent housing connection to the center housing and the center housing connection to the lower bent housing each comprise a 0.5 degree angle and are mirror symmetric with respect to a plane of intersection.
Figure 11:
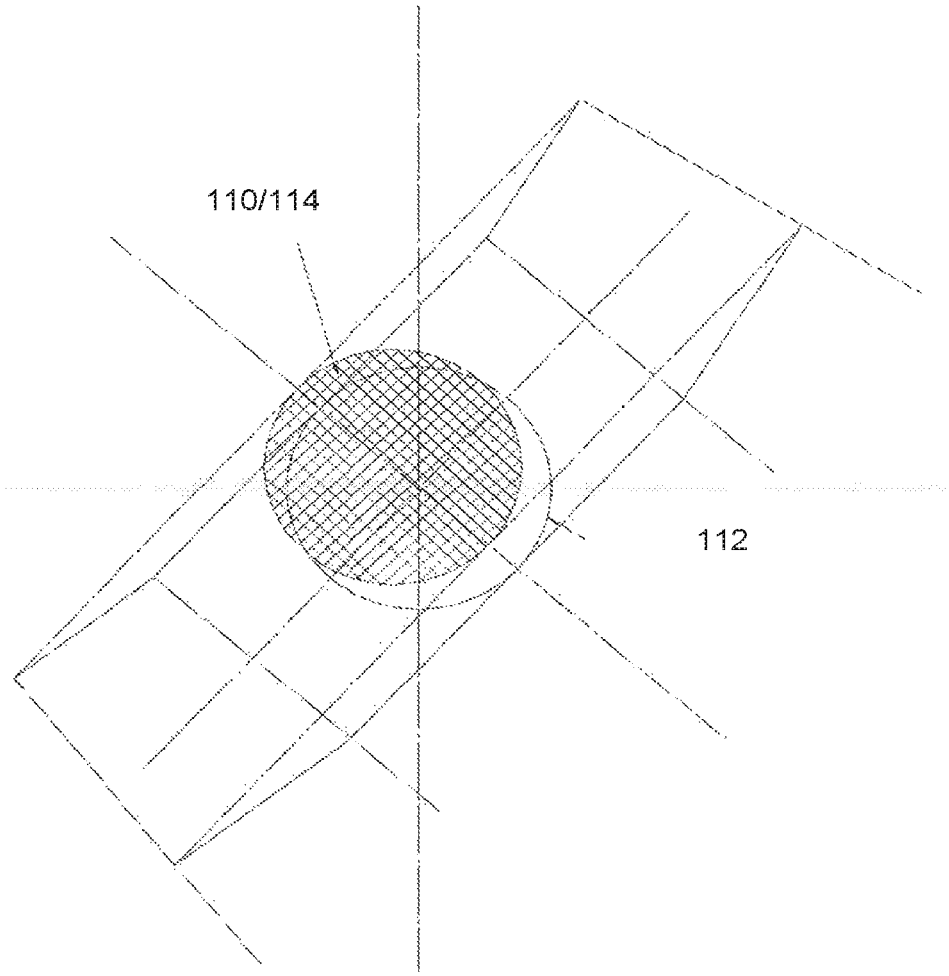
FIG. 11 shows a similar cross-section to FIG. 10, but wherein the individual connection angles are 1.0 degrees.

FIG. 10 shows a cross section similar to those shown in FIGS. 9 and 11 but with the selected total bend angle being intermediate zero total bend angle and the maximum total bend angle.

Figure 12:
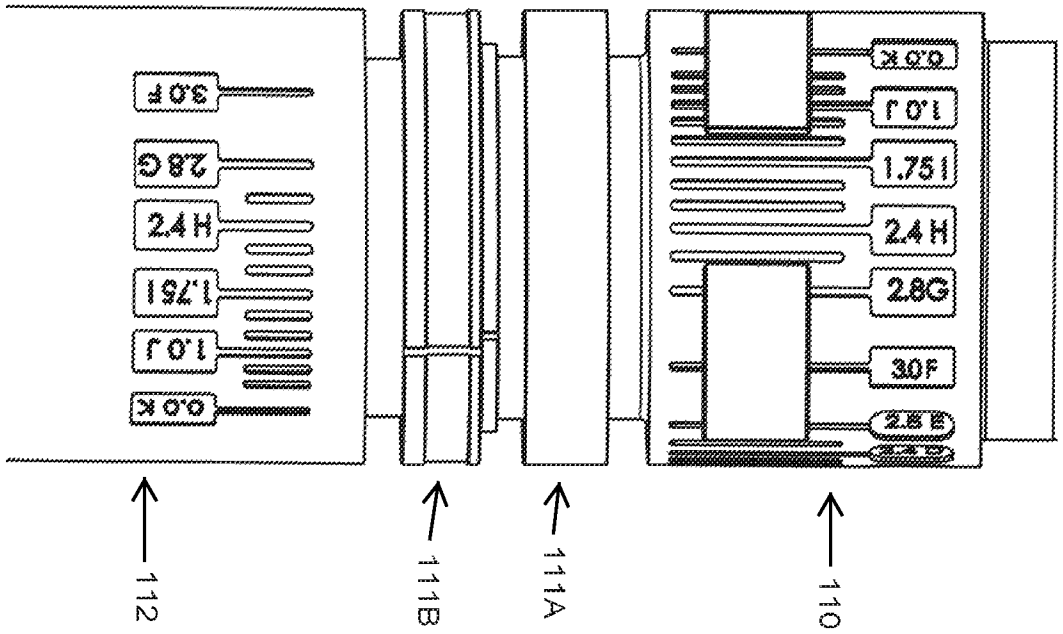
FIG. 12 shows a more detailed view of angle alignment markings on one of the bent subs (e.g., the first or upper bent sub) and the center section.

FIG. 12 shows an example embodiment of making up a threaded connection between the upper bent housing 110 and the center housing 112 so that angle selection alignment markings (see 110A and 112A in FIG. 3) may be in respective alignment when the threaded connection is assembled to within its recommended "make up" torque range. The gap (112G in FIG. 3) may be filled using fixed thickness split rings 111B (or one or more solid rings), and a machinable ring 111A that can be milled or otherwise machined to a thickness selected to provide that the respective angle markings 111A, 111B will align between the upper bent housing 110 and the center housing 112 when the threaded connection between them is assembled to the make up torque. The fully assembled upper bent housing 110, rings 111A, 111B and center housing 112 are shown in FIG. 13. Thickness to which the machinable ring 111A may be set may be determined, for example, using Eq. (2) above.

FIGS. 14A and 14B show, respectively, an ADB motor having bent housings to result in a 2.4 degree bend angle, first, in FIG. 14A in the plane of the bend and second, in FIG. 14B in the plane perpendicular to the bend plane.

In some embodiments, the oriented axis of the upper bent housing, the center housing and a lower bent housing are all on a single plane at any bend angle and provide a single toolface orientation.

In some embodiments the upper and lower bend angles are made through oriented shoulders lockable in rotation with teeth to allow on site adjustment without dismantling the bent housings from the center housing.

In some embodiments, the variable thickness rings comprise opposed pairs of sloped rings lockable in rotation and assembled in a selected rotational orientation to a selected bend angle without dismantling the upper bent housing from the center housing and the center housing from the lower bent housing.

It will be appreciated by those skilled in the art that various forms of power section, including but not limited to a positive displacement motor, a turbine motor, an electric motor may all be used to equal effect. In principle, the benefits of an ADB motor according to the present disclosure are a result of the unique structure of the components of the motor housing.

Although only a few examples have been described in detail above, those skilled in the art will readily appreciate that many modifications are possible with reference to the illustrated examples, in particular and without limitation regarding the components and techniques to obtain an adjustable bent connection at each end of the center section. A variety of solutions to such technical issue are known and could be used instead of the illustrated example shown herein with split plates and threads on an oriented axis. The ADB motor could be made, for example, with oriented faces and shoulders at each end with teeth and a torquing sleeve to select each bend. In other examples the rings may be made with tapered shoulder rings lockable in rotation and allowing variable thickness between shoulders with a similar oriented thread as shown in the present example embodiment. Accordingly, all such modifications are intended to be included within the scope of this disclosure as defined in the following claims.

What is claimed is:

1. An adjustable double bend steerable drilling motor, comprising:

a center cylindrical housing comprising a threaded connection at each end for respectively coupling to an upper bent housing and a lower bent housing, the threaded connection at said each end subtending an angle from a centerline of the center cylindrical housing, an angle at a first end oriented in a same direction as an angle at a second end;

each bent housing comprising a threaded connection at one end for coupling to a respective connection on the center cylindrical housing, said each bent housing subtending a selected angle between the respective connection and a connector for coupling said each bent housing within a drill string; and makeup rings having a selected axial thickness disposed between a gap of said each bent housing and the center cylindrical housing whereby selected angle markers on said each bent housing correspond to adjacent markings on the center cylindrical housing when said each bent housing is assembled to the center housing to a predetermined torque; and wherein the makeup rings comprise a split ring and an adjustable axial thickness ring, the adjustable axial thickness ring adjustable to a selected axial thickness.

2. The motor of claim 1, wherein the adjustable axial thickness ring has an axial thickness selected by machining.

3. The motor of claim 1, wherein the adjustable thickness ring comprises opposed rings each having a tapered shoulder on one side such that selective rotation of the opposed rings results in the selected axial thickness.

4. The motor of claim 1, wherein an oriented axis of the center cylindrical housing and the bent housings are all on a single plane at any total bend angle and provide a single tool face orientation.

5. The motor of claim 1, wherein the makeup rings comprise opposed pairs of rings lockable in rotation assembled in a rotational orientation to a selected bend angle without dismantling the bent housings from the center cylindrical housing.

6. The motor of claim 1, wherein the bent housings are affixable to the center cylindrical housing such that a total bend angle in the motor is within a range from zero to a sum of bend angles of the bent housings.

7. The motor of claim 1, wherein an upper bend and a lower bend are made using a set of modular split rings divided in half and lockable in rotation, to allow on site adjustment without dismantling the bent housings from the center cylindrical housing.

8. A method for drilling a well, comprising:

assembling an upper bent housing, a center housing and a lower bent housing of a double bend steerable drilling motor, makeup rings having a selected axial distance disposed between a gap of each bent housing and the center housing, so as to cause the double bend steerable drilling motor to have a selected total bend angle;

moving fluid through a power section in the double bend steerable drilling motor to rotate a drill bit rotationally coupled to a longitudinal end of the double bend steerable drilling motor; and advancing the drill bit through the well by applying axial force to the double bend steerable drilling motor;

wherein the center housing comprises a connection at each longitudinal end for coupling to a respective one of the upper bent housing and the lower bent housing, the connection at said each longitudinal end subtending a same angle from a centerline of the center housing, the angle at a first longitudinal end oriented in a same direction as the angle at a second longitudinal end, each bent housing comprising a threaded connection at one end for coupling to a respective connection on the center housing, said each bent housing subtending a selected angle between the respective connection and a connector for coupling said each bent housing within a drill string, the double bend steerable drilling motor comprising the makeup rings having a selected axial thickness disposed between said each bent housing and the center housing whereby selected angle markers on said each bent housing correspond to adjacent markings on the center housing when said each bent housing is assembled to the center housing to a makeup torque; and wherein the makeup rings comprise a split ring and an adjustable axial thickness ring, the adjustable axial thickness ring adjustable to a selected axial thickness.

9. The method of claim 8, wherein the adjustable axial thickness ring has an axial thickness selected by machining.

10. The method of claim 8, wherein the adjustable axial thickness ring comprises opposed rings each having a tapered shoulder on one side such that selective rotation of the opposed rings results in the selected axial thickness.

11. The method of claim 8, wherein an oriented axis of the upper bent housing, the center housing and the lower bent housing are all on a single plane at any bend directional control with a single tool face orientation.

12. The method of claim 8, wherein the adjustable axial thickness rings comprise opposed pairs of rings lockable in rotation and assembled in a rotational orientation to a selected bend angle without dismantling the bent housings from the center cylindrical housing.

13. The method of claim 8, wherein the bent housings are affixable to the center housing such that a total bend angle in the motor is within a range from zero to a sum of bend angles of the bent housings.

14. The method of claim 8, wherein an upper bend and a lower bend are made using a set of modular split rings divided in half and lockable in rotation, to allow on site adjustment without dismantling the bent housings from the center housing.

* * * * *